United States Patent [19]

Martini

[11] 4,420,145

[45] Dec. 13, 1983

[54] WALKING BEAM FURNACE FOR HEATING METALLURGIC MATERIALS WITH DIFFERENT INLET TEMPERATURES

[75] Inventor: Iacopo Martini, Genoa, Italy

[73] Assignee: Italimpianti Societa Italiana impianti, p.A., Genoa, Italy

[21] Appl. No.: 353,094

[22] Filed: Mar. 1, 1982

[30] Foreign Application Priority Data

Mar. 31, 1981 [IT] Italy ..... 12482 A/81

[51] Int. Cl.[3] ..... F27B 9/14

[52] U.S. Cl. ..... 266/90; 266/87; 266/252; 432/122; 148/155

[58] Field of Search ..... 266/87, 90, 252, 251, 266/249; 432/122, 11, 128, 239; 148/155, 153

[56] References Cited

U.S. PATENT DOCUMENTS 3,854,863 12/1974 Lubold, Jr. et al. ..... 432/11
4,025,298 5/1977 Tokitsu ..... 432/122

FOREIGN PATENT DOCUMENTS 135237 4/1979 Fed. Rep. of Germany ..... 432/128

*Primary Examiner*—L. Dewayne Rutledge
*Assistant Examiner*—Christopher W. Brody
*Attorney, Agent, or Firm*—King and Liles

[57] ABSTRACT

In the walking beam furnaces, in order to heat metallurgical materials such as billets, bars and the like, having different temperatures of introduction into the furnace and/or different cross sections, so as to discharge materials at uniform temperatures from the furance, said materials are selected according to their temperature and/or cross section, and are introduced into the furnace through a plurality of side inlet doors while said materials are conveyed along the furnace by means of an external side conveyor, and/or they are discharged from the furnace through a plurality of side outlet doors and are then advanced outside along the furnace by means of an external side conveyor. The external side conveyor can be formed by a walking beam conveyor, timed with the internal walking beam conveyor as to the length and rate of steps, and/or timed in relation therewith so that at each occupied position on the external walking beam conveyor always corresponds an unoccupied position on the internal walking beam conveyor, and vice versa. The external conveyor can be enclosed in a chamber which, if desired, is insulated and is associated with heating means such as the exhaust gases discharged from the furnace.

9 Claims, 1 Drawing Figure

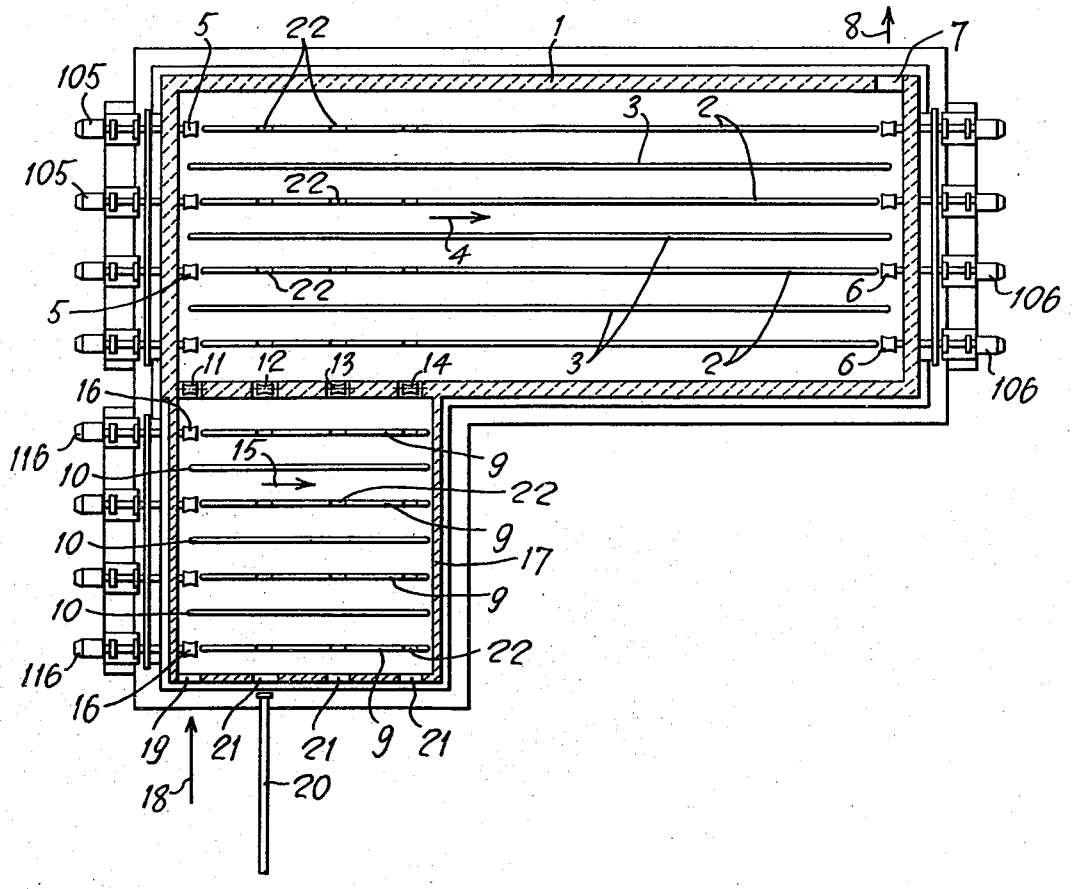
105
105
5
22
22
22
5
1
8
7
106
106
6
6
2
2
3
3
4
11
12
13
14
15
16
16
10
10
10
116
116
9
9
9
9
22
22
17
21
21
21
20
19
18

WALKING BEAM FURNACE FOR HEATING METALLURGIC MATERIALS WITH DIFFERENT INLET TEMPERATURES

BACKGROUND AND SUMMARY OF THE INVENTION

This invention relates to a walking beam furnace for heating metallurgic materials such as billets, bars, blooms and the like, having different temperatures of introduction into the furnace and/or different cross sections, particularly different thicknesses and/or different characteristics, and/or being distinguished from one another by any other characteristic requiring different heating time.

The higher quality of the steel products obtained by a continuous casting process permits to omit, in many cases, any inspection of the cast materials, which inspection requires the cooling of said materials to temperatures approaching the ambient temperature. This simplification, inter alia, ensures the advantage from the standpoint of energy saving, to load into the heating and balancing furnaces materials which are still hot as coming from the continuous casting operation. This advantage of introducing high-temperature materials is not possible in the known walking beam furnaces, since the latter are intended to receive a charge comprising materials at approximately the same temperature. In fact, should some articles be introduced at temperatures considerably different from the average temperature, they would be discharged from the furnace at a temperature lower than that required for the rolling operation, or they would be overheated or partially molten. In order to avoid this drawback as much as possible, the operation of the rolling mill downstream of the walking beam heating furnace must be timed with the operation of the continuous casting process, so that the heated materials reach the furnace without effecting dwells of variable duration, thus avoiding any different degree of cooling of the materials.

However, practically, this requirement gives rise to some difficulties, particularly in the installations comprising one single continuous casting apparatus and one signal rolling mill line. To avoid said difficulties, in order to obtain a uniform temperature of the heated articles at the outlet of the walking beam furnace, it is even preferred a complete cooling of all the articles coming from the continuous casting, thus losing the advantages of introducing the articles into the furnace in a hot condition.

This invention aims to avoid said drawbacks and its object is to provide a heating method, in combination with walking beam furnaces, permitting to introduce into a furnace series of articles (billets, bars, blooms) having temperatures and/or cross sections, particularly thicknesses and/or characteristics considerably different from one another, and yet to obtain at the outlet of the furnace articles having a temperature which is substantially the same and is suitable for rolling mill action. The method of the invention, therefore, permits an elastic association between the hot rolling mill downstream of the walking beam furnace and the apparatus upstream of said furnace.

The method of the invention substantially comprises the steps of feeding the materials to be heated, at least partially, along the outer side of the furnace in the same direction as the materials within the furnace and of introducing them laterally into said furnace at different and varying positions as a function of their temperature and/or cross-section, particularly their thickness and/or quality and/or any other characteristic. Under another aspect of the invention, in combination with the above method or as an alternative thereto, the heated materials are discharged laterally from the furnace at different and varying positions when they reach the desired discharge temperature, and the discharged materials are then advanced along the outer side of the furnace in the same direction as the materials within the furnace.

To carry this method into effect, the invention provides a walking beam furnace, substantially characterized in that it comprises a plurality of successive inlet or introduction doors and a plurality of successive outlet or discharge doors, and, on at least one side portion of the furnace, adjacent and longitudinally thereto, in register with the introduction and/or discharge doors, it comprises an external conveyor for the materials (billets, blooms, bars) which is timed with the walking beam conveyor within the furnace and is adapted to advance the materials in the same direction and at the same speed as the walking beam internal conveyor, means being provided to introduce the materials from the external conveyor into the furnace through any of the side introduction doors onto the walking beam internal conveyor, and/or discharge the materials through any of the side discharge doors onto said external conveyor, and detection and control means being provided to select—as a function of the temperature and/or thickness, and/or quality—the oncoming materials to be heated and to introduce them directly into the furnace through the first introduction door or to send them onto the corresponding external conveyor and introduce them with a longer or shorter delay through one of the successive side introduction doors in register with an unoccupied place on the internal walking beam conveyor, and/or to select the heated articles and discharge them through the last discharge door or with a longer or shorter advance through one of the preceding side discharge doors, onto the corresponding external conveyor.

The walking beam furnace with external timed conveyor according to the invention can be constructed in several ways. Thus, for example, the external conveyor associated to a plurality of successive doors can be provided only at the inlet side or at the outlet side, or both at the inlet and outlet sides. The succession of inlet or outlet doors can be so constructed as to allow the passage of one article at a time, or otherwise they can be wide enough to permit each the introduction and/or discharge of one article at different positions along the furnace. If desired, one single side inlet and/or outlet door could be provided extending along the entire length of the respective external conveyor.

The external conveyor and the inlet or outlet means associated therewith can be constructed in various ways. In a preferred embodiment, the external conveyor comprises a step-by-step conveyor, preferably a walking beam conveyor similar to the internal walking beam conveyor. The means to introduce the materials into the furnace from the external side conveyor and/or to discharge the materials onto the external side conveyor can comprise one or more axial load pushers.

If desired, in proximity of the side external inlet or outlet conveyor, a suitable heating means can be provided for the materials being conveyed on said external conveyor, for example to avoid or to minimize the cooling of these materials and/or to effect a pre-heating thereof. For this purpose, according to the invention, the side external conveyor (or conveyors) can be enclosed within respective chambers, preferably insulated and suitably heated, for example, by the exhaust gases of the walking beam furnace.

BRIEF DESCRIPTION OF THE DRAWINGS

These and other features of the invention and the advantages resulting therefrom will be apparent from the following description of a walking beam furnace according to the invention, shown as a non-limitating example, in top plan view and partly broken away, in the single FIGURE of the accompanying drawing.

DESCRIPTION OF THE PREFERRED EMBODIMENT OF THE INVENTION

In the drawing, the numeral 1 indicates the chamber of a walking beam furnace for treating metallurgical materials such as billets. The numeral 2 indicates the stationary beams and the numeral 3 indicates the walking beams of the walking beam conveyor within the furnace 1.

The direction of the step-by-step feed of the bilets in the furnace 1 by the action of the walking beam conveyor 3 is indicated by the arrow 4. Arranged at the inlet end portion within the furnace 1, is a transverse line of driven rollers 5 with respective drive motors 105. A similar transverse line of driven rollers 6 is also arranged within the furnace 1 at the outlet end portion thereof. The numeral 106 indicates the respective drive motors for the rollers 6 of this discharge line. The billets are discharged through a side door 7 in the direction indicated by the arrow 8.

At the inlet end portion of the furnace 1, in the wall opposite to that having the side discharge door 7, the furnace chamber is formed with a plurality of successive inlet doors 11, 12, 13, 14 of such a size as to permit each the introduction of one billet at a time. The inlet side doors are arranged in the direction of the longitudinal feed movement 4 of the billets in the furnace. The center-to-center distance between the successive side inlet doors 11, 12, 13, 14 corresponds to one or more feed steps of the billets in the furnace 1 by the action of the internal walking beam conveyor 3. The first side inlet door 11 is in line with the introduction line of rollers 5, and the following side inlet doors 12, 13, 14 are in register with the successive positions of the billets on the stationary beams 2 in the furnace 1 in the course of feed.

Arranged opposite the region of the side inlet doors 11, 12, 13, 14 and adjacent to the furnace 1 is an external walking beam conveyor 10 which is parallel to the walking beam conveyor 3 in the furnace 1 and extends along a fraction of the length of the furnace. The direction of feed 15 of the external walking beam conveyor 10 is the same as the direction 4 of the internal walking beam conveyor 3.

The numeral 9 indicates the stationary beams of the external walking beam conveyor 10 which is associated to a transverse line of driven feed rollers 16, in line with the first inlet door 11 and with the subsequent line of inlet rollers 5 within the furnace 1.

The walking beam conveyor 10 outside the furnace 1 is enclosed, preferably, in a suitable chamber 17 which, if desired, can be insulated. The walking beam conveyor 10 outside the furnace 1 and the walking beam conveyor 3 inside the furnace 1 have the same step of feed and are timed with each other.

The billets to be heated, for example, coming from a continuous casting apparatus, move in the direction of the arrow 18 and are positioned longitudinally in the same direction as said arrow on the line of driven feed rollers 16, through a corresponding side inlet door 19 formed in the chamber 17.

For the same quality, thickness or cross section the oncoming billets are selected and classified on the basis of their temperature.

Depending upon their temperature, the billets are introduced into the furnace 1 through the side inlet door 11, 12, 13, 14 corresponding to the point on the heating curve relating to the temperature of each single billet.

In particular, the colder billets are introduced into the furnace directly from the line of feed rolers 16 through the first inlet door 11 onto the line of driven feed rollers 5, wherefrom they are picked up by the walking beam 3 of the internal conveyor and are advanced step-by-step in the direction 4 along the whole length of the furnace 1. These colder billets, therefore will stay for a longer period in the furnace 1 and will be heated to a greater extent.

However, the hotter billets will be stopped on the line of driven feed rollers 16 and will be picked up therefrom by the walking beam 10 of the external conveyor, and will be advanced step-by-step by said conveyor in the direction of feed 15 which is the same as the direction of feed 4 of the billets within the furnace. At each billet picked up and advanced by the walking beam conveyor 10 outside the furnace 1, one place will be left free in the series of billets being advanced on the walking beam conveyor 3 inside the furnace 1. The positions that the billets can assume on the stationary beams 2 of the internal conveyor are in line with the positions that the billets can assume on the stationary beams 9 of the external conveyor. Therefore, the billet picked up by the external conveyor and the corresponding place therefor which has been left free on the internal conveyor will be advanced in synchronism and in line with each other in the same directions 15 and 4.

When the initially hotter billet advanced on the external walking beam conveyor 10 reaches a position along the furnace wherefrom the heating of this billet in the remaining fraction of the furnace would cause a discharge temperature which is substantially the same as that of the initially colder billet introduced directly through the first side inlet door 11, said hotter billet is also introduced into the furnace 1 through one of the remaining side inlet doors 12, 13, 14. This introduction of the billet into the furnace 1 from the external walking beam conveyor 10 to the internal walking beam conveyor 3 through one of the side inlet doors 12, 13, 14 is effected by means of one or more axial load pushers 20 that can be introduced into the chamber 17 form the side opposite the furnace 1 through openings 21 in line with said inlet doors 12, 13, 14. The introduction of the billets through the side doors 12, 13, 14 preferably occurs when the internal walking beams 3 and the external walking beams 10 are in their lowered positions and the billets will rest on the stationary beams 2 and 9. In this instance, the internal stationary beams 2 and the external stationary beams 9 are suitably shaped so as to form aligned transverse guides 22 for the billets at each side inlet door 12, 13, 14.

It is apparent from the above that at each position occupied by a billet on the external walking beam conveyor 10 always corresponds an unoccupied position on the internal walking beam conveyor 3, whereby no interference can occur upon the delayed introduction of the hotter billets through one of the introduction doors 12, 13, 14 downstream of the first door 11 for direct introduction. It is also apparent that the billets will be discharged from the door 7 in the same order they had when fed to the furnace in the direction of the arrow 18 on the line of feed roller 16, and principally with discharge temperatures which are substantially uniform and corresponding to the rolling temperature.

The above described selection of the billets on the basis of their temperatures can be either automatic and/or manual and can be effected either with one single measurement or detection of the temperature during the feeding of the billets to the furnace and automatic control system based on the cooling curve of these billets, or with a plurality of direct and successive measurements, for example at the positions of the billets at each side inlet door 11, 12, 13, 14.

The detection means is a portion of an actuating system that suitably controls the movement of the lines of driven rollers 5, 16, the opening and closing of the inlet doors 11, 12, 13, 14, the action of the load pusher or pushers 20, and the movement of the internal and external walking beams 3 and 10.

The invention permits, however, to heat by means of the same walking beam furnace, up to a uniform discharge temperature, materials having not only different temperatures at the introduction step, but also or only different thicknesses, different cross sections and/or different qualities. In this instance, the selection and control system will be designed to take into account not only the temperature of the single oncoming articles to be heated, but also or only their thickness, cross section and/or quality, to determine which is the side door 11, 12, 13, 14 through which each article is to be introduced into the furnace in order to obtain the desired discharge temperature.

To minimize the heating requirements of the billets or the like being advanced on the external walking beam conveyor 10 before introducing them through one of the successive side inlet doors 12, 13, 14, said chamber 17 enclosing the external conveyor 10 can be insulated and can also be suitably heated, particularly by means of the exhaust gases from the furnace 1. In this instance, the chamber 17 enclosing said external conveyor 10 can be considered as a pre-heating chamber or vestibule for the furnace 1, and the heating diagrams of the vestibule and the furnace will be differentiated and will intersect at the confluence of the materials, that is where the materials will be transferred from the vestibule 17 into the furnace 1.

The billets can be introduced into the furnace through the side inlet doors 12, 13, 14 by means of a plurality of axial load pushers, and particularly a suitable axial load pusher in registry with each inlet door 12, 13, 14, or one single axial load pusher 20 adapted to be reciprocatably moved into registry with any one of the side inlet doors 12, 13, 14.

The invention can be applied not only for introducing the materials into a walking beam furnace, but also for discharging the heated materials from said furnace. Stated otherwise, instead of conveying the initially hotter billets outside along the furnace and introducing them with a shorter or longer delay at different points along the furnace as a function of their temperature and/or cross section and/or quality, so as to discharge them all from the same point at a substantially uniform temperature, said billets can be introduced into the furnace all at the same point in the usual way, and discharged from the furnace with a shorter or longer advance at different points along the furnace, when they reach the desired uniform discharge temperature, and thereafter they can be further moved outside along the furnace to the point of confluence with the flow of billets advanced within the furnace.

Of course, the invention can be applied contemporarily both for the introduction into the furnace and for the discharge therefrom.

The invention can be used with any type of walking beam furnace, regardless of the construction thereof, regardless of the means for actuating the walking beams, and of the heating and control means for the furnace.

In particular, the invention can be also applied to the existing walking beam furnaces for the purpose of converting them into furnaces according to the invention since the necessary modifications to the furnace only require a sufficient space available at either side of the furnace.

It will be apparent from the above that the invention is not limited to the embodiments herein shown and described, but changes and modifications can be broadly made thereto without departing from the basic principle set forth hereinabove and claimed hereinafter.

I claim:

1. A walking beam furnace for heating metallurgical materials such as billets, blooms, bars and the like, comprising:

a plurality of successive side doors along said furnace;

external conveyor means along at least one side of said furnace, said external conveyor means being located adjacent to said side doors;

internal conveyor means within said furnace, said internal and external conveyor means advancing with corresponding speed and direction;

introduction means for introducing materials into said furnace, said materials passing from said external conveyor means through any of said side doors to said internal conveyor means;

discharge means for discharging materials from said furnace, said materials passing from said internal conveyor means through any of said side doors to said external conveyor means; and detection and control means for detecting temperature and cross-section of said materials and controlling introduction and discharge of said materials through said side doors of said furnace, said detection and control means thereby providing said materials, regardless of shape or initial temperature, with a substantially uniform temperature upon discharge from said furnace.

2. A furnace according to claim 1, wherein said furnace further comprises an introduction and discharge side, each side including a plurality of successive side doors and having an external conveyor means associated therewith.

3. A furnace according to claim 1, wherein said side inlet and outlet doors are constructed of such a width as to extend along the whole length of said external conveyor means each allowing introduction or discharge of materials at various positions along said furnace.

4. A furnace according to claim 1, wherein said internal and external conveyor means are formed by walking beam conveyors actuated in synchronization so that each occupied position on said external conveyor means has a corresponding unoccupied position on said internal conveyor means and each occupied position on said internal conveyor means has a corresponding unoccupied position on said external conveyor means.

5. A furnace according to claim 4, wherein said internal and external conveyors include stationary beams corresponding with each side door, said beams being formed with transverse guides for said materials, said guides being in line with each other.

6. A furnace according to claim 5, wherein said introduction and discharge means comprise one or more axial pushers.

7. A furnace according to claim 6, wherein said external conveyor means is enclosed within an insulated chamber associated with heating means for said materials.

8. A furnace according to claim 7, wherein said heating means comprises exhaust gases from said walking beam furnace.

9. A furnace according to claim 7, wherein said insulated and heated chamber enclosing said external conveyor means forms a vestibule of the walking beam furnace, the heating diagrams of the vestibule and the furnace being differentiated and intersecting at confluence points of said materials.

* * * * *